US012599245B2

(12) United States Patent
Chung

(10) Patent No.: US 12,599,245 B2
(45) Date of Patent: Apr. 14, 2026

(54) WIDTH-ADJUSTABLE FOLDABLE BED

(71) Applicant: Ulife Healthcare Inc., Taoyuan City (TW)

(72) Inventor: Ya-Hsin Chung, Taichung City (TW)

(73) Assignee: Ulife Healthcare Inc., Taoyuan City (TW)

( * ) Notice: Subject to any disclaimer, the term of this patent is extended or adjusted under 35 U.S.C. 154(b) by 19 days.

(21) Appl. No.: 18/765,287

(22) Filed: Jul. 7, 2024

(65) Prior Publication Data

US 2025/0295241 A1 Sep. 25, 2025

(30) Foreign Application Priority Data

Mar. 20, 2024 (TW) ..... 113202789

(51) Int. Cl.
*A47C 19/04* (2006.01)
*A47C 19/12* (2006.01)
*A47C 20/04* (2006.01)

(52) U.S. Cl.
CPC ..... *A47C 19/045* (2013.01); *A47C 19/124* (2013.01); *A47C 20/041* (2013.01)

(58) Field of Classification Search
CPC ..... A61G 7/002; A61G 7/005; A61G 7/015; A61G 7/018; A47C 20/12; A47C 20/10; A47C 20/08; A47C 20/041; A47C 20/04; A47C 19/021; A47C 19/00; A47C 19/12; A47C 19/122; A47C 19/126; A47C 21/006; A61H 23/0254; A61H 23/0263; A61H 2023/0272; A61H 2023/0281; A61H 2023/029; A61H 23/04; Y10S 5/933
USPC ..... 5/640
See application file for complete search history.

(56) References Cited

U.S. PATENT DOCUMENTS

| | | | | |
|---|---|---|---|---|
| 9,009,888 | B1 * | 4/2015 | Tekulve | A61G 7/015 5/202 |
| 9,387,140 | B2 * | 7/2016 | Tekulve | A61G 13/129 |
| 10,912,390 | B1 * | 2/2021 | Chung | A47C 19/04 |
| 2005/0166323 | A1 * | 8/2005 | Kawakami | A61G 7/015 5/613 |
| 2009/0077748 | A1 * | 3/2009 | Kim | A61G 7/053 5/613 |
| 2009/0293197 | A1 * | 12/2009 | Larson | A61G 7/002 5/613 |
| 2019/0231078 | A1 * | 8/2019 | Chung | A47C 19/025 |
| 2020/0237105 | A1 * | 7/2020 | Eskridge, III | A47C 27/14 |

* cited by examiner

*Primary Examiner* — J. T. Newton
(74) *Attorney, Agent, or Firm* — Muncy, Geissler, Olds & Lowe, P.C.

(57) ABSTRACT

A width-adjustable foldable bed includes a main bed frame unit that includes a first bed frame subunit and a second bed frame subunit. The second bed frame subunit is pivotable relative to the first bed frame subunit to fold the main bed frame unit from a bed flat state, where the first bed frame subunit and the second bed frame subunit are arranged in a lengthwise direction, to a bed folded state, where the first bed frame subunit is stacked on top of the second bed frame subunit. Two lateral bed frame units are connected to two lateral sides of the first bed frame subunit and the second bed frame subunit. A backrest actuating device is connected to the first bed frame subunit, and is operable for driving the first bed frame subunit to switch between a first flat state and a first bent state.

9 Claims, 12 Drawing Sheets

WIDTH-ADJUSTABLE FOLDABLE BED

CROSS-REFERENCE TO RELATED APPLICATION

This application claims priority to Taiwanese Utility Model Patent Application No. 113202789, filed on Mar. 20, 2024, the entire disclosure of which is incorporated by reference herein.

FIELD

The disclosure relates to a bed, and more particularly to a width-adjustable foldable bed.

BACKGROUND

An existing electric bed, as disclosed in Taiwanese Utility Model Patent No. M589548, is electrically operable to control a height and an inclination of a back rest frame.

The existing electric bed may be in the form of a double bed that is foldable to reduce the length. However, the existing electric bed has an unchangeable width, which is likely to increase a dimension of the existing electric bed to be transported when it is in a folded state, thereby causing the transport cost for the network-based sale of the existing electric bed to be raised.

SUMMARY

Therefore, an object of the disclosure is to provide a width-adjustable foldable bed that is likely to reduce in dimension, thereby reducing the transport cost.

According to the disclosure, the width-adjustable foldable bed includes a support unit, a main bed frame unit, two lateral bed frame units, and a driving unit.

The main bed frame unit is disposed on the support unit, and includes a first bed frame subunit and a second bed frame subunit connected to the first bed frame subunit. The second bed frame subunit is pivotable relative to the first bed frame subunit to fold the main bed frame unit from a bed flat state, where the first bed frame subunit and the second bed frame subunit are arranged in a lengthwise direction, to a bed folded state, where the first bed frame subunit is stacked on top of the second bed frame subunit.

The two lateral bed frame units are respectively and detachably connected to two lateral sides of the first bed frame subunit and the second bed frame subunit, and are opposite to each other in a widthwise direction perpendicular to the lengthwise direction.

The driving unit includes a backrest actuating device connected to the first bed frame subunit, and is operable for driving the first bed frame subunit to switch between a first flat state and a first bent state.

BRIEF DESCRIPTION OF THE DRAWINGS

Other features and advantages of the disclosure will become apparent in the following detailed description of the embodiment(s) with reference to the accompanying drawings. It is noted that various features may not be drawn to scale.

DETAILED DESCRIPTION

Figure 1:
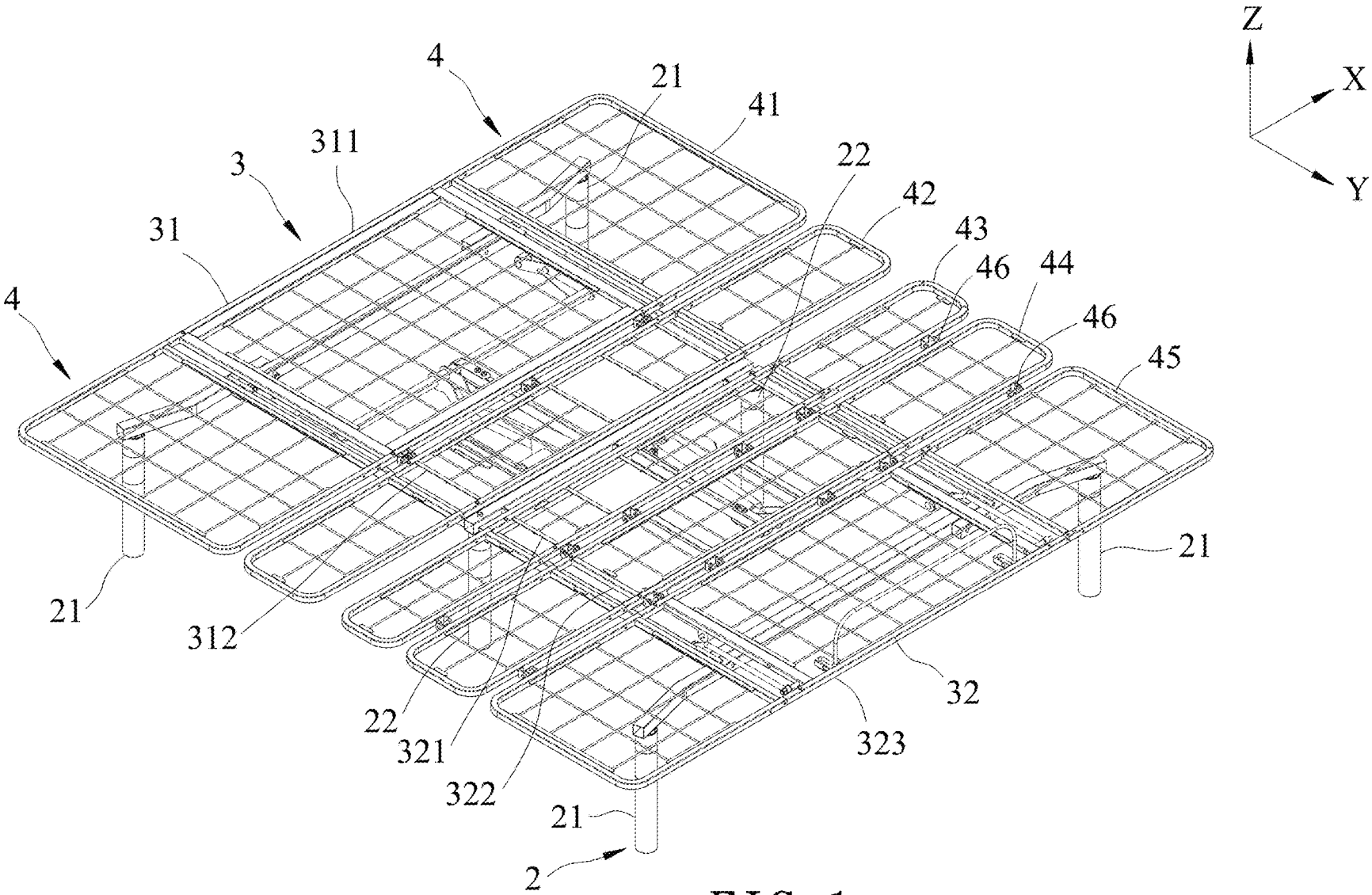
FIG. 1 is a perspective view illustrating a width-adjustable foldable bed according to an embodiment of the disclosure in a flattened state.

Before the disclosure is described in greater detail, it should be noted that where considered appropriate, reference numerals or terminal portions of reference numerals have been repeated among the figures to indicate corresponding or analogous elements, which may optionally have similar characteristics.

It should be noted herein that for clarity of description, spatially relative terms such as "top," "bottom," "upper," "lower," "on," "above," "over," "downwardly," "upwardly" and the like may be used throughout the disclosure while making reference to the features as illustrated in the drawings. The features may be oriented differently (e.g., rotated 90 degrees or at other orientations) and the spatially relative terms used herein may be interpreted accordingly.

Figure 2:
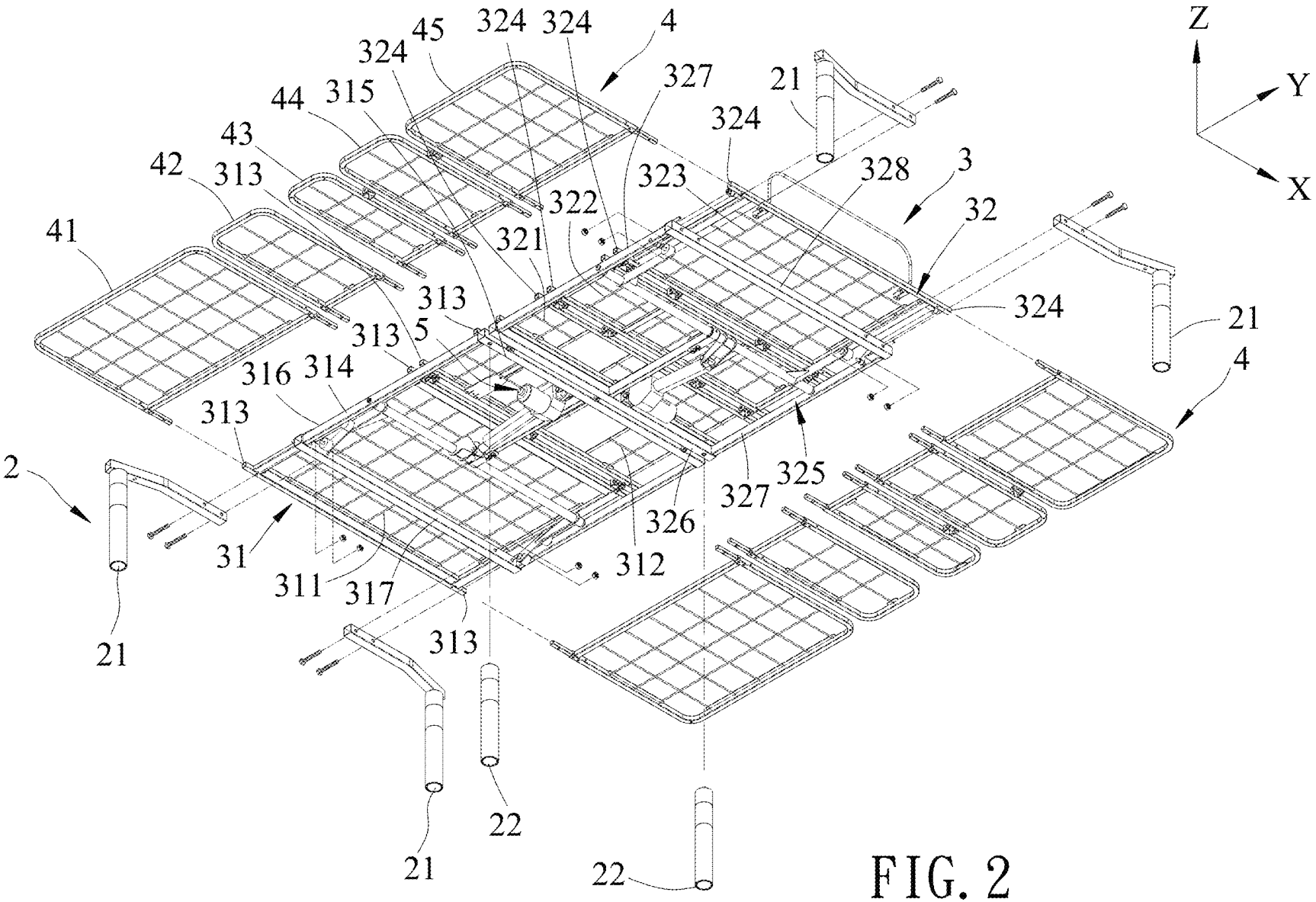
FIG. 2 is a partly exploded perspective view of the embodiment.
Figure 3:
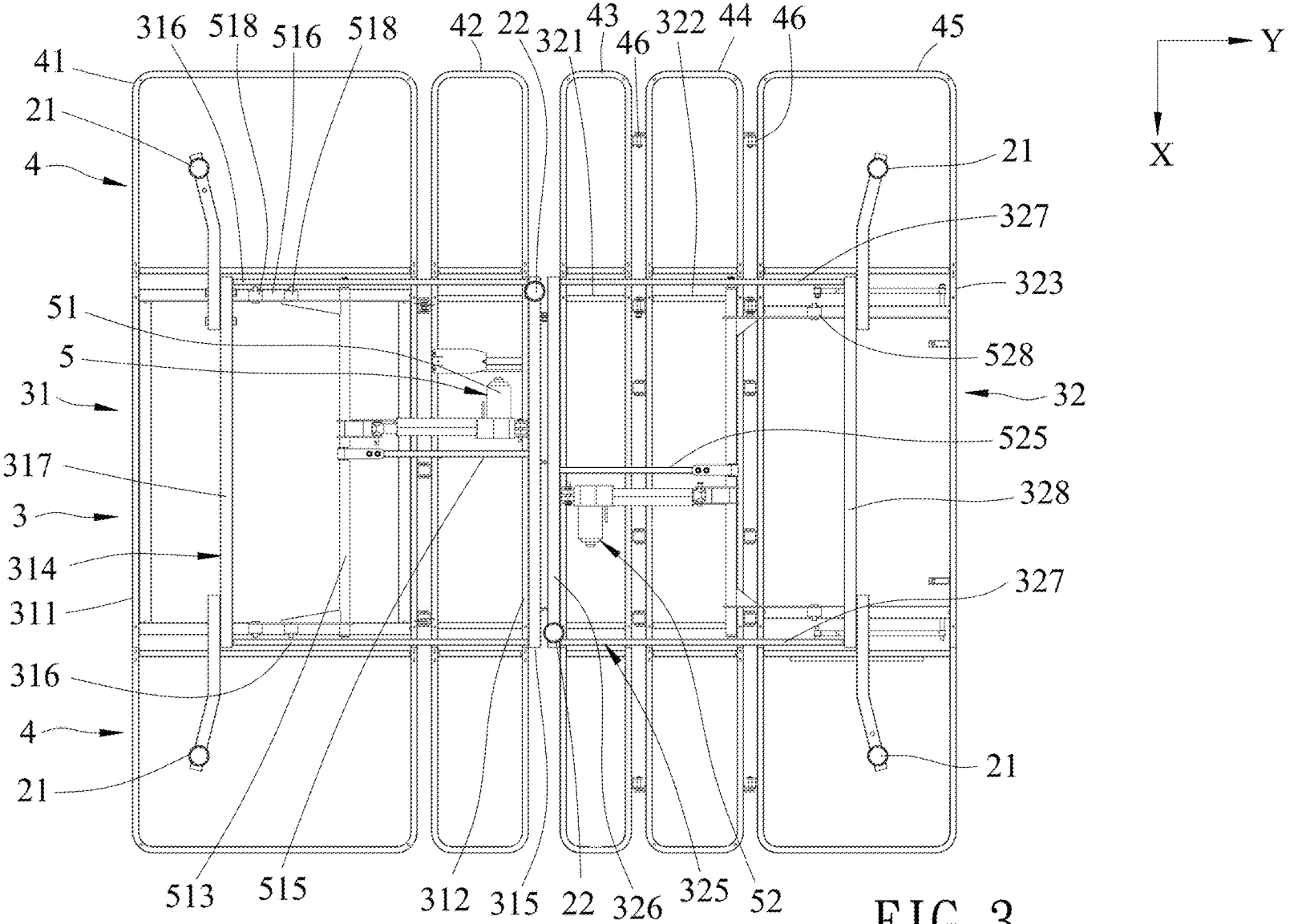
FIG. 3 is a fragmentary bottom view of the embodiment illustrating the width-adjustable foldable bed in the flattened state with omission of a lattice structure.

FIGS. 1 to 3 illustrate a width-adjustable foldable bed according to an embodiment of the disclosure. The width-adjustable foldable bed includes a support unit 2, a main bed frame unit 3, two lateral bed frame units 4, and a driving unit 5. In FIG. 3, a lattice structure of the main bed frame unit 3 is omitted for clarity.

The support unit 2 includes a plurality of outer bed legs 21 and a plurality of intermediate bed legs 22. In this embodiment, the number of the outer bed legs 21 is four, and the number of the intermediate bed legs 22 is two. However, the number of the outer bed legs 21 and the number of the intermediate bed legs 22 are not limited hereto.

The main bed frame unit 3 is disposed on the support unit 2 and includes a first bed frame subunit 31 and a second bed frame subunit 32 connected to the first bed frame subunit 31.

Figure 6:
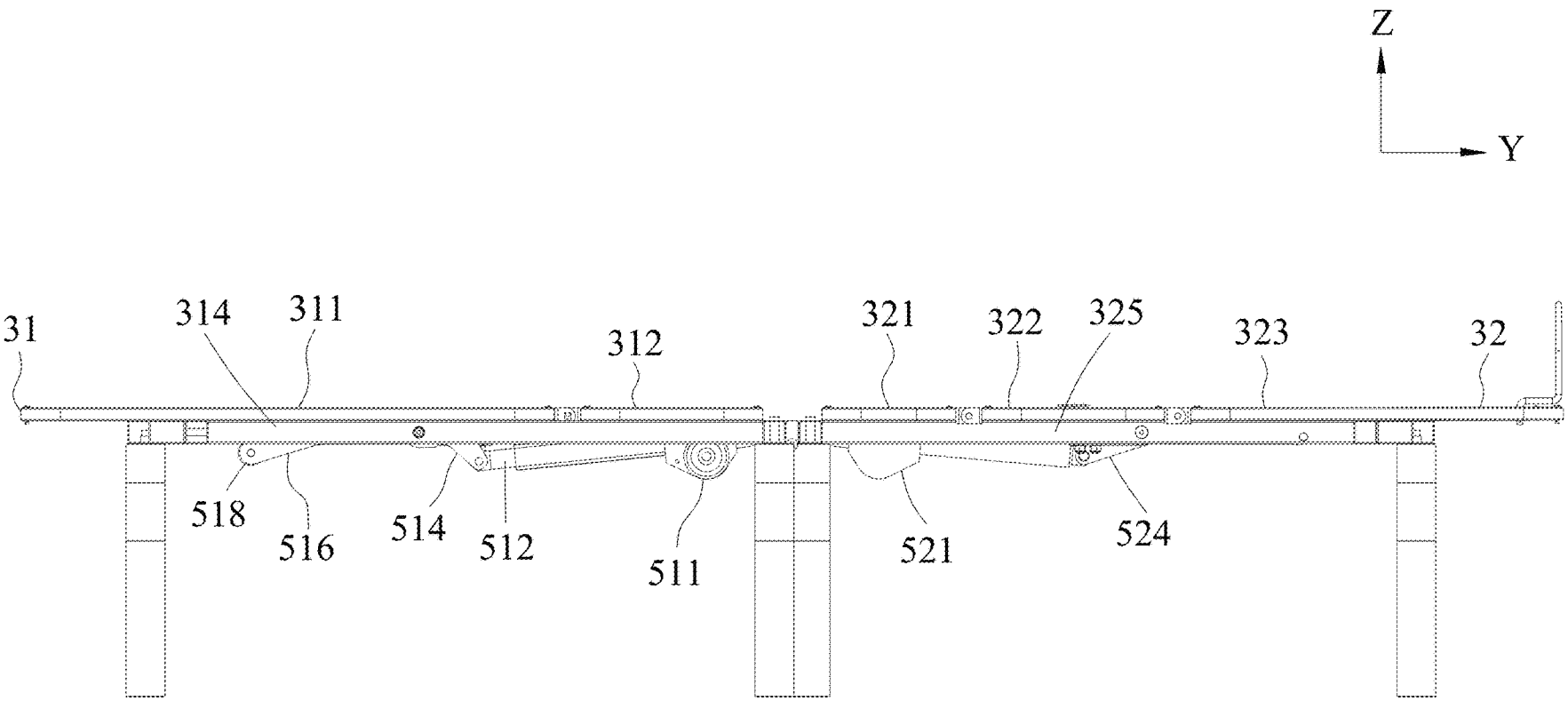
FIG. 6 is a side view of the embodiment illustrating the width-adjustable foldable bed in the flattened state.
Figure 10:
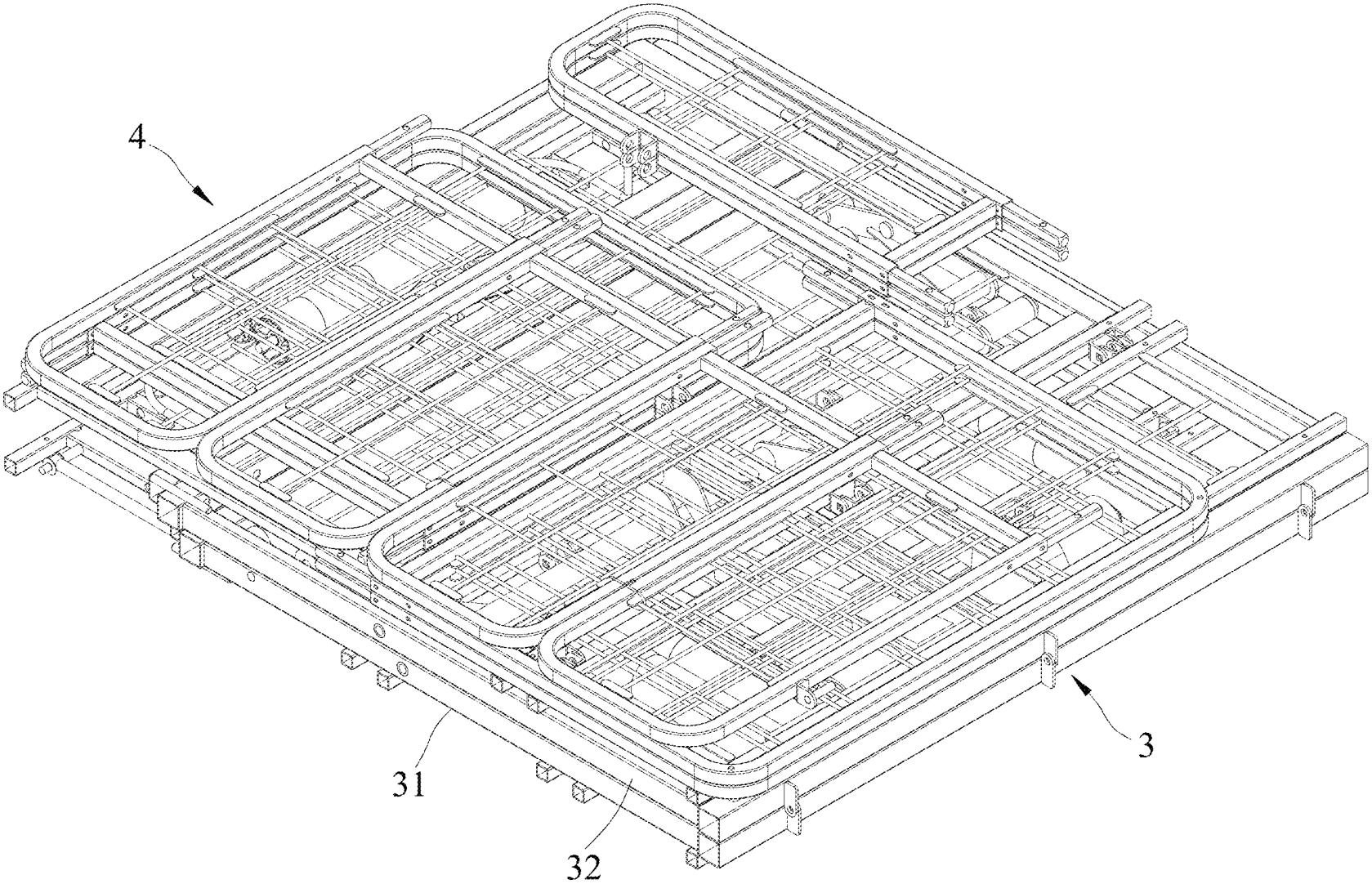
FIG. 10 is a perspective view of the embodiment illustrating the width-adjustable foldable bed in a folded state.

The second bed frame subunit 32 is pivotable relative to the first bed frame subunit 31 to fold the main bed frame unit 3 from a bed flat state, where the first bed frame subunit 31 and the second bed frame subunit 32 are arranged in a lengthwise direction (Y) as shown in FIG. 6, to a bed folded state, where the first bed frame subunit 31 is stacked on top of the second bed frame subunit 32 as shown in FIG. 10.

Figure 9:
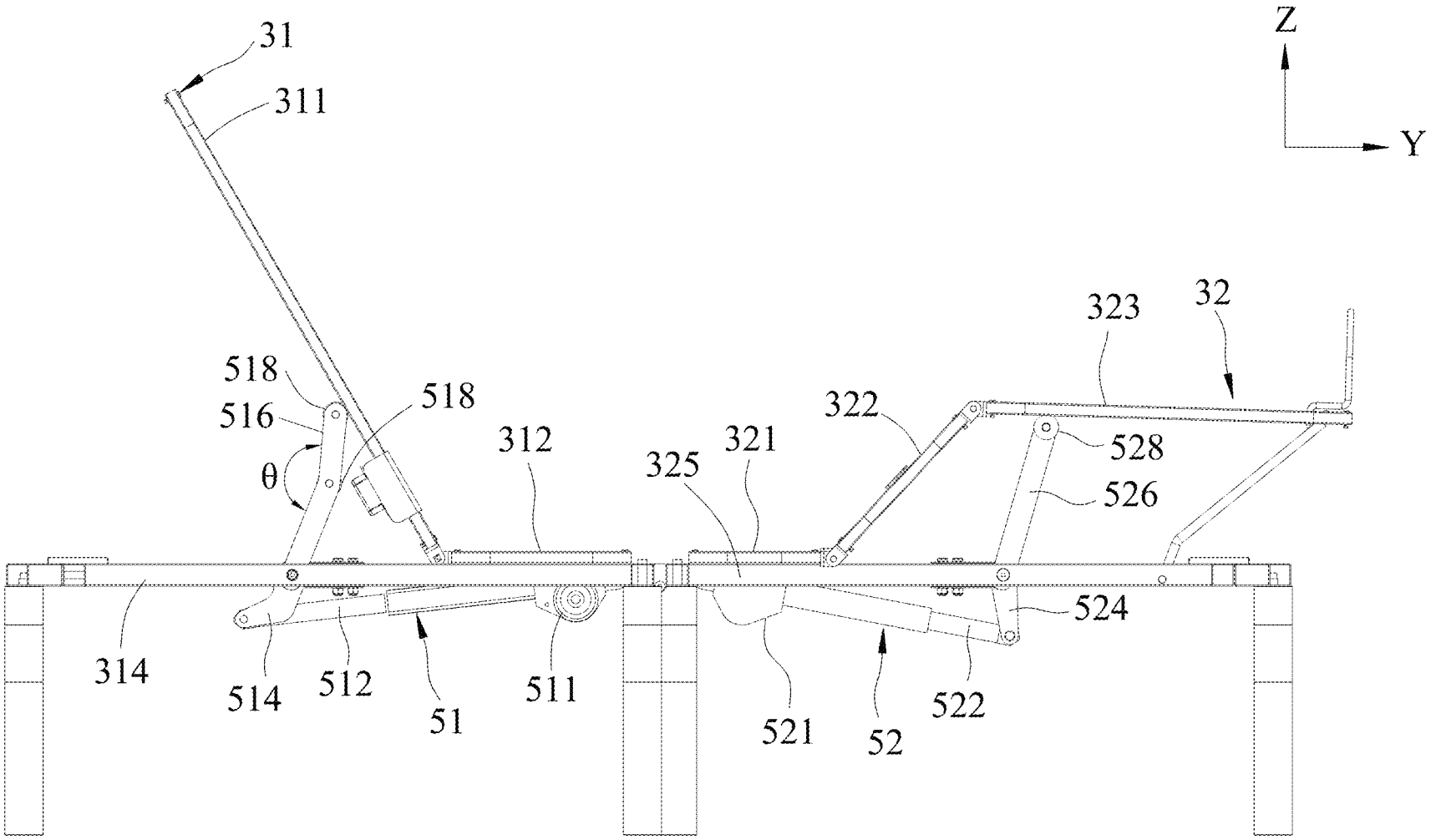
FIG. 9 is a side view of FIG. 8 but the lateral bed frame units are omitted.

In this embodiment, the first bed frame subunit 31 is switchable between a first flat state (see FIG. 6) and a first bent state (see FIG. 9). The first bed frame subunit 31 includes a main backrest frame 311, a first main fixing frame 312, and a first bed seat 314.

Figure 4:
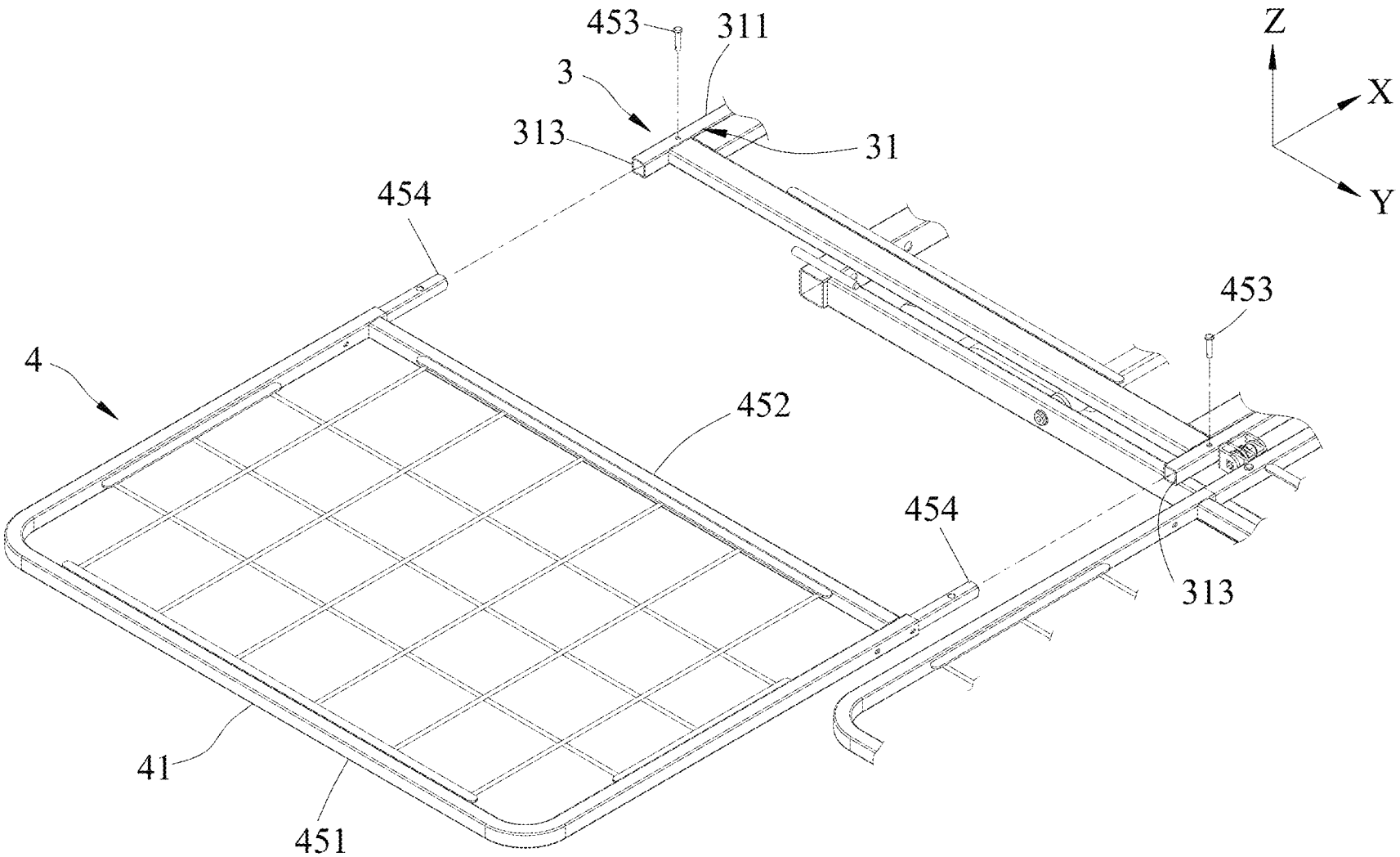
FIG. 4 is a fragmentary enlarged perspective view of the embodiment illustrating a first bed frame subunit and a lateral backrest frame of the width-adjustable foldable bed.

As shown in FIGS. 1, 2, and 4, the main backrest frame 311 is a lattice frame. In this embodiment, the main backrest frame 311 includes four first tubular coupling portions 313 (only three of them can be seen in FIG. 2) that are respectively extended outwardly from four corners of the main backrest frame 311 in a widthwise direction (X) perpendicular to the lengthwise direction (Y).

The first main fixing frame 312 is pivotally connected to the main backrest frame 311, and is a lattice frame. As shown in FIG. 2, the first main fixing frame 312 includes four first tubular coupling portions 313 (only two of them can be seen) that are respectively extended outwardly from four corners of the first main fixing frame 312 in the widthwise direction (X).

Referring back to FIGS. 2 and 3, the first bed seat 314 has a first connecting frame portion 315, two first lateral portions 316, and a first transverse reinforcement rod 317. The first connecting frame portion 315 is elongated in the widthwise direction (X), and supports the first main fixing frame 312. The two first lateral portions 316 are spaced apart from each other in the widthwise direction (X) and are elongated in the lengthwise direction (Y). The main backrest frame 311 is movably disposed on the first lateral portions 316. The first transverse reinforcement rod 317 is spaced apart from the first connecting frame portion 315 in the lengthwise direction (Y), and has two ends that are opposite to each other in the widthwise direction (X) and that are respectively connected to the first lateral portions 316 to reinforce a structural strength of the first bed seat 314. In this embodiment, the first lateral portions 316 and the first transverse reinforcement rod 317 have a square tubular cross section (not shown). Two outer bed legs 21 are detachably fastened to the first transverse reinforcement rod 317 by screws. One of the intermediate bed legs 22 is detachably fastened to the first connecting frame portion 315.

The second bed frame subunit 32 is switchable between a second flat state (see FIG. 6) and a second bent state (see FIG. 9).

The second bed frame subunit 32 has a second main fixing frame 321, a main leg frame 322, a main foot frame 323, and a second bed seat 325.

As shown in FIGS. 1 to 3, the second main fixing frame 321 is pivotally connected to the first main fixing frame 312. In this embodiment, as shown in FIG. 2, the second main fixing frame 321 is a lattice frame, and includes four second tubular coupling portions 324 (only two of them can be seen) that are respectively extended outwardly from four corners of the second main fixing frame 321 in the widthwise direction (X).

The main leg frame 322 is pivotally connected to the second main fixing frame 321 and is a lattice frame. As shown in FIG. 2, the main leg frame 322 includes four second tubular coupling portions 324 (only two of them can be seen) that are respectively extended outwardly from four corners of the main leg frame 322 in the widthwise direction (X).

The main foot frame 323 is pivotally connected to the main leg frame 322 and is a lattice frame. As shown in FIG. 2, the main foot frame 323 includes four second tubular coupling portions 324 (only three of them can be seen) that are respectively extended outwardly from four corners of the main foot frame 323 in the widthwise direction (X).

As shown in FIGS. 2 and 3, the second bed seat 325 has a second connecting frame portion 326, two second lateral portions 327, and a second transverse reinforcement rod 328. The second connecting frame portion 326 is elongated in the widthwise direction (X), and supports the second main fixing frame 321. The two second lateral portions 327 are spaced apart from each other in the widthwise direction (X) and are elongated in the lengthwise direction (Y). The main leg frame 322 and the main foot frame 323 are movably disposed on the second lateral portions 327. The second transverse reinforcement rod 328 is spaced apart from the second connecting frame portion 326 in the lengthwise direction (Y), and has two ends that are opposite to each other in the widthwise direction (X) and that are respectively connected to the second lateral portions 327 to reinforce a structural strength of the second bed seat 325. In this embodiment, the second lateral portions 327 and the second transverse reinforcement rod 328 have a square tubular cross section (not shown). The other two outer bed legs 21 are detachably fastened to the second transverse reinforcement rod 328 by screws. The other intermediate bed leg 22 is detachably fastened to second connecting frame portion 326. The intermediate bed leg 22 detachably fastened to the first connecting frame portion 315 and the intermediate bed leg 22 detachably fastened to the second connecting frame portion 326 are opposite to each other in the widthwise direction (X).

The two lateral bed frame units 4 are respectively and detachably connected to two lateral sides of the first bed frame subunit 31 and the second bed frame subunit 32, and are opposite to each other in the widthwise direction (X). As shown in FIGS. 1 to 3, each of the lateral bed frame units 4 includes a lateral backrest frame 41, a first lateral fixing frame 42, a second lateral fixing frame 43, a lateral leg frame 44, a lateral foot frame 45, and a plurality of coupling sets 46.

Figure 5:
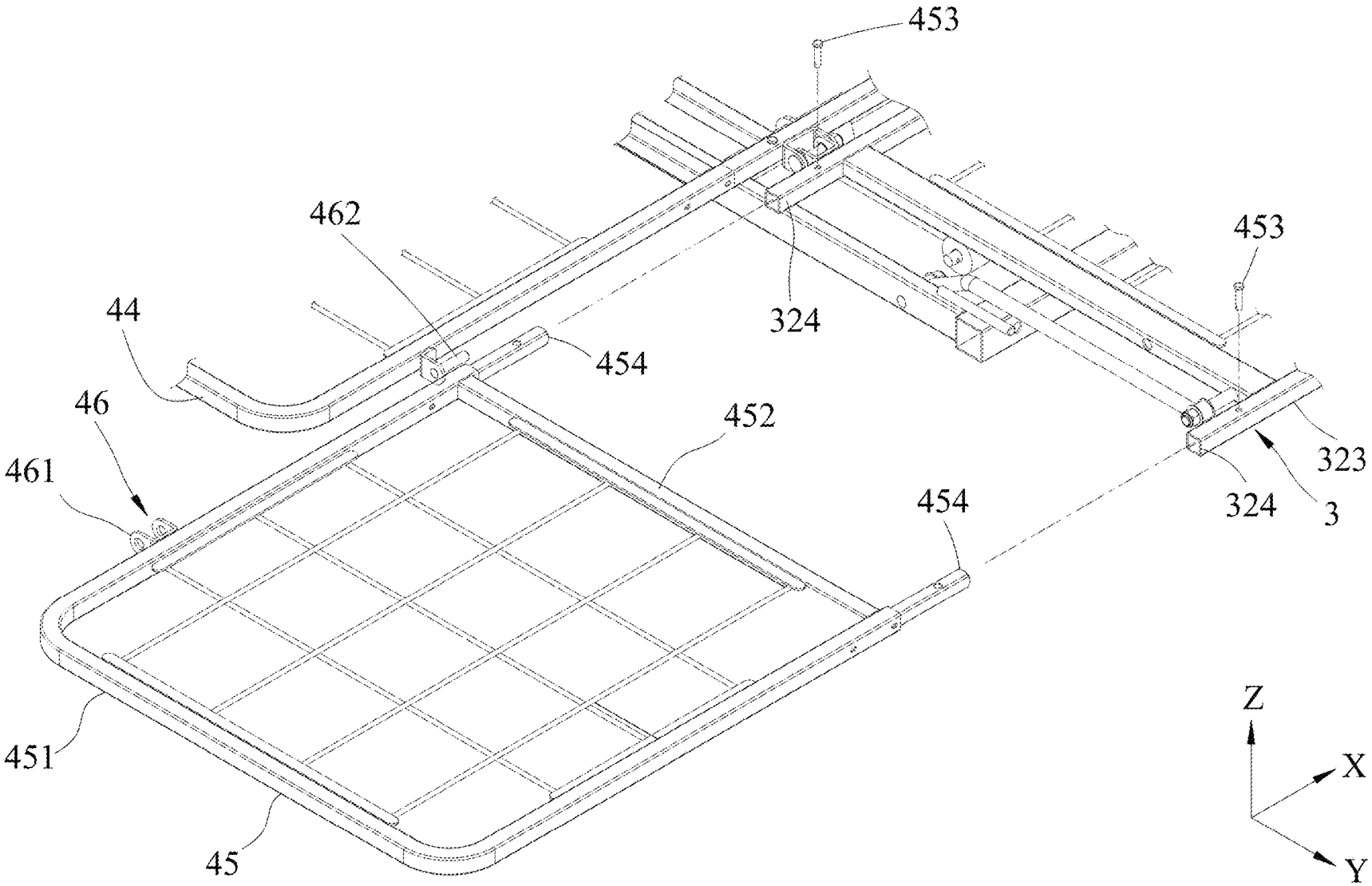
FIG. 5 is a fragmentary enlarged perspective view of the embodiment illustrating a lateral leg frame, a lateral foot frame, coupling sets and a main foot frame of the width-adjustable foldable bed.

As shown in FIGS. 1, 2, 4 and 5, each of the lateral backrest frame 41, the first lateral fixing frame 42, the second lateral fixing frame 43, the lateral leg frame 44, and the lateral foot frame 45 is a lattice frame that has a U-shaped frame member 451 and a connecting frame member 452. The connecting frame member 452 is elongated in the lengthwise direction (Y) and interconnects two opposite end portions of the U-shaped frame member 451. The U-shaped frame member 451 has two connecting tube portions 454 that respectively extend from and are respectively reduced in size from the two opposite end portions of the U-shaped frame member 451. As shown in FIGS. 2, 4 and 5, for each of the lateral bed frame units 4, the connecting tube portions 454 of the lateral backrest frame 41 and the first lateral fixing frame 42 respectively and detachably extend into the first tubular coupling portions 313 of the main backrest frame 311 and the first main fixing frame 312, and the connecting tube portions 454 of the second lateral fixing frame 43, the lateral leg frame 44, and the lateral foot frame 45 respectively and detachably extend into the second tubular coupling portions 324 of the second main fixing frame 321, the main leg frame 322, and the main foot frame 323. In this embodiment, each of the lateral bed frame units 4 further includes a plurality of connecting pins 453. The connecting pins 453 respectively and removably fasten the connecting tube portions 454 to the first tubular coupling portions 313, and the connecting tube portions 454 to the second tubular coupling portions 324. By virtue of the connecting tube portions 454, the first tubular coupling portions 313, the second tubular coupling portions 324, and the connecting pins 453 cooperating with each other, the lateral backrest frame 41 is detachably connected to the main backrest frame 311. The first lateral fixing frame 42 is detachably connected to the first main fixing frame 312. The second lateral fixing frame 43 is detachably connected to the second main fixing frame 321. The lateral leg frame 44 is detachably connected to the main leg frame 322. The lateral foot frame 45 is detachably connected to the main foot frame 323.

The coupling sets 46 are disposed between the second lateral fixing frame 43 and the lateral leg frame 44 and between the lateral leg frame 44 and the lateral foot frame 45, such that the second lateral fixing frame 43 and the lateral leg frame 44 are detachably and pivotally connected to each other, and that the lateral leg frame 44 and the lateral foot frame 45 are detachably and pivotally connected to each other. Each of the coupling sets 46 has a hole plate seat 461 and a securing pin 462 that detachably extends in the widthwise direction (X) into the hole plate seat 461. For each of the coupling sets 46 disposed between the second lateral fixing frame 43 and the lateral leg frame 44, the hole plate seat 461 and the securing pin 462 are respectively disposed on the second lateral fixing frame 43 and the lateral leg frame 44. For each of the coupling sets 46 disposed between the lateral leg frame 44 and the lateral foot frame 45, the hole plate seat 461 and the securing pin 462 are respectively disposed on the lateral foot frame 45 and the lateral leg frame 44. Noticeably, for clarity, the lateral foot frame 45 is depicted in a disassembled manner as shown in FIG. 5. In practice, the lateral leg frame 44 and the lateral foot frame 45 are first assembled with each other, and then are assembled to the main bed frame unit 3.

Figure 7:
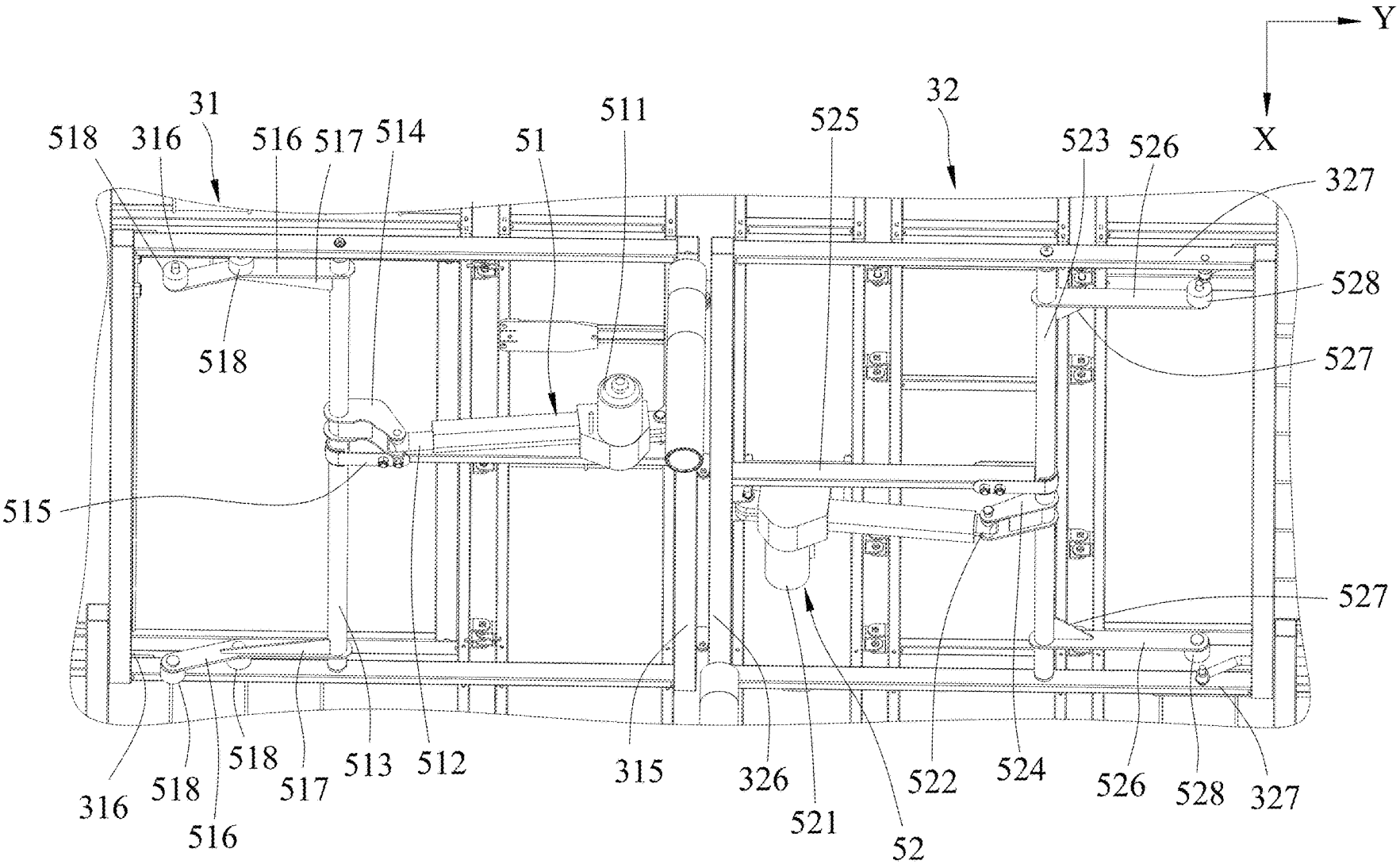
FIG. 7 is a fragmentary perspective bottom view illustrating the width-adjustable foldable bed of the embodiment.

Referring to FIGS. 3, 6, and 7, the driving unit 5 includes a backrest actuating device 51 and a leg-foot actuating device 52.

Figure 8:
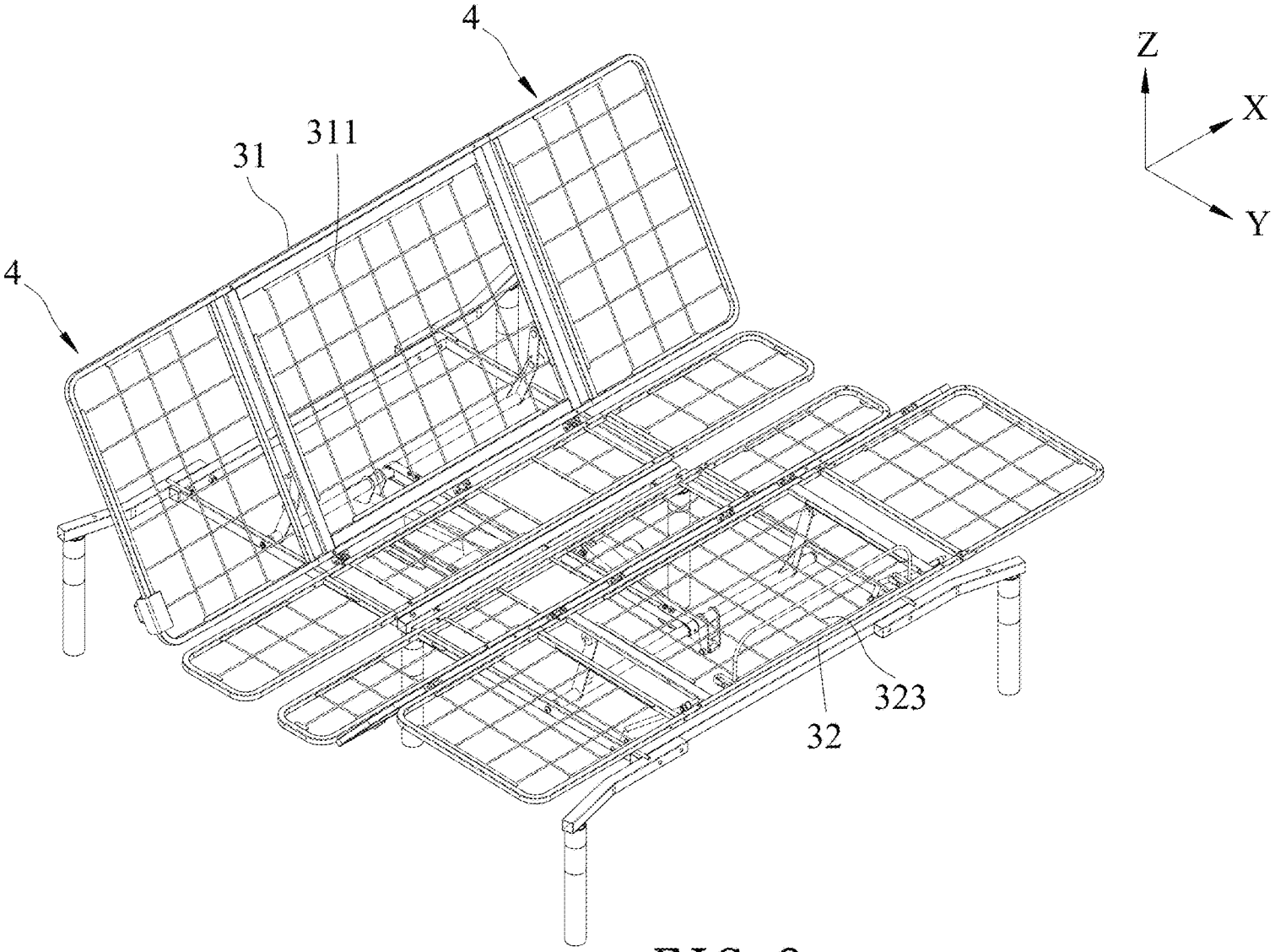
FIG. 8 is a perspective view of the embodiment illustrating two lateral bed frame units driven by the first bed frame subunit that is in a first bent state and a second bed frame subunit that is in a second bent state.

The backrest actuating device 51 is connected to the first bed frame subunit 31, and is operable for driving the first bed frame subunit 31 to switch between the first flat state (as shown in FIGS. 1 and 6) and the first bent state (as shown in FIGS. 8 and 9) in a top-bottom direction (Z) that is perpendicular to the lengthwise direction (Y) and the widthwise direction (X).

The backrest actuating device 51 includes a backrest actuating motor 511, a backrest actuating rod 512, a backrest rotary rod 513, a backrest connecting member 514, a backrest support rod 515, two backrest driving plates 516, two backrest reinforcement plates 517, and a plurality of backrest rollers 518. The backrest actuating motor 511 is mounted on the first connecting frame portion 315 of the first bed seat 314. The backrest actuating rod 512 telescopically extends from the backrest actuating motor 511 in the lengthwise direction (Y). The backrest rotary rod 513 is elongated in the widthwise direction (X) and rotatably interconnects the first lateral portions 316 of the first bed seat 314. The backrest connecting member 514 has an end pivotally connected to the backrest actuating rod 512 and an opposite end fixedly connected to the backrest rotary rod 513. The backrest support rod 515 is elongated in the lengthwise direction (Y) and interconnects the first connecting frame portion 315 of the first bed seat 314 and the backrest rotary rod 513, and the backrest rotary rod 513 is rotatable relative to the backrest support rod 515. The two backrest driving plates 516 are spaced apart from each other in the widthwise direction (X), are pivotally connected to opposite ends of the backrest rotary rod 513, and extend opposite to the backrest connecting member 514. Each of the backrest reinforcement plates 517 is connected between the backrest rotary rod 513 and a respective one of the backrest driving plates 516. The backrest rollers 518 are rotatably mounted to the backrest driving plates 516.

As shown in FIGS. 3, 7, and 9, each of the backrest driving plates 516 has an extension portion that extends from the backrest rotary rod 513, and a bent portion that extends from the extension portion and that has a distal end distal from the backrest rotary rod 513. For each of the backrest driving plates 516, an included angle (θ) is formed between the extension portion and the bent portion, and is smaller than 180 degrees and greater than 90 degrees. The backrest rollers 518 are respectively disposed on the distal ends of the backrest driving plates 516 and junctions between the extension portions and the bent portions of the backrest driving plates 516. By virtue of the include angle (θ) formed between the extension portion and the bent portion of each of the backrest driving plates 516, the backrest rollers 518 may be driven by the backrest driving plates 516 in stages to abut against and to incline the main backrest frame 311, so that damage to the backrest driving plates 516 may be prevented and a movement speed of the main backrest frame 311 may be balanced.

The backrest actuating motor 511 is operable to actuate telescopic action of the backrest actuating rod 512 to result in rotation of the backrest rotary rod 513 via pivot connection between the backrest actuating rod 512 and the backrest connecting member 514, so that the distal ends of the backrest driving plates 516 are driven to move upwardly to pivot the main backrest frame 311 relative to the first main fixing frame 312, during which the backrest rollers 518 roll along the main backrest frame 311, thereby switching the first bed frame subunit 31 to the first bent state (see FIG. 9).

The leg-foot actuating device 52 is connected to the first bed frame subunit 31, and is operable for driving the second bed frame subunit 32 to switch between the second flat state, as shown in FIGS. 1 and 6, and the second bent state, as shown in FIGS. 8 and 9, in the top-bottom direction (Z).

The leg-foot actuating device 52 includes a leg-foot actuating motor 521, a leg-foot actuating rod 522, a leg-foot rotary rod 523, a leg-foot connecting member 524, a leg-foot support rod 525, two leg-foot driving plates 526, two leg-foot reinforcement plates 527, and a plurality of leg-foot rollers 528. The leg-foot actuating motor 521 is mounted on the second connecting frame portion 326 of the second bed seat 325. The leg-foot actuating rod 522 telescopically extends from the leg-foot actuating motor 521 in the lengthwise direction (Y). The leg-foot rotary rod 523 is elongated in the widthwise direction (X) and rotatably interconnects the second lateral portions 327 of the second bed seat 325. The leg-foot connecting member 524 has an end pivotally connected to the leg-foot actuating rod 522 and an opposite end fixedly connected to the leg-foot rotary rod 523. The leg-foot support rod 525 is elongated in the lengthwise direction (Y) and interconnects the second connecting frame portion 326 of the second bed seat 325 and the leg-foot rotary rod 523, and the leg-foot rotary rod 523 is rotatable relative to the leg-foot support rod 525. The two leg-foot driving plates 526 are spaced apart from each other in the widthwise direction (X), are connected to opposite ends of the leg-foot rotary rod 523, and extend opposite to the leg-foot connecting member 524. Each of the leg-foot reinforcement plates 527 is connected between the leg-foot rotary rod 523 and a respective one of the leg-foot driving plates 526. The leg-foot rollers 528 are rotatably mounted to the leg-foot driving plates 526

The leg-foot actuating motor 521 is operable to actuate telescopic action of the leg-foot actuating rod 522 to result in rotation of the leg-foot rotary rod 523 via pivot connection between the leg-foot actuating rod 522 and the leg-foot connecting member 524, so that distal ends of the leg-foot driving plates 526 are driven to lift the main foot frame 323 so as to drive the main leg frame 322 to be inclined relative to the second main fixing frame 321, during which the leg-foot rollers 528 roll along the main foot frame 323, thereby switching the second bed frame subunit 32 to the second bent state (see FIG. 9).

Figure 11:
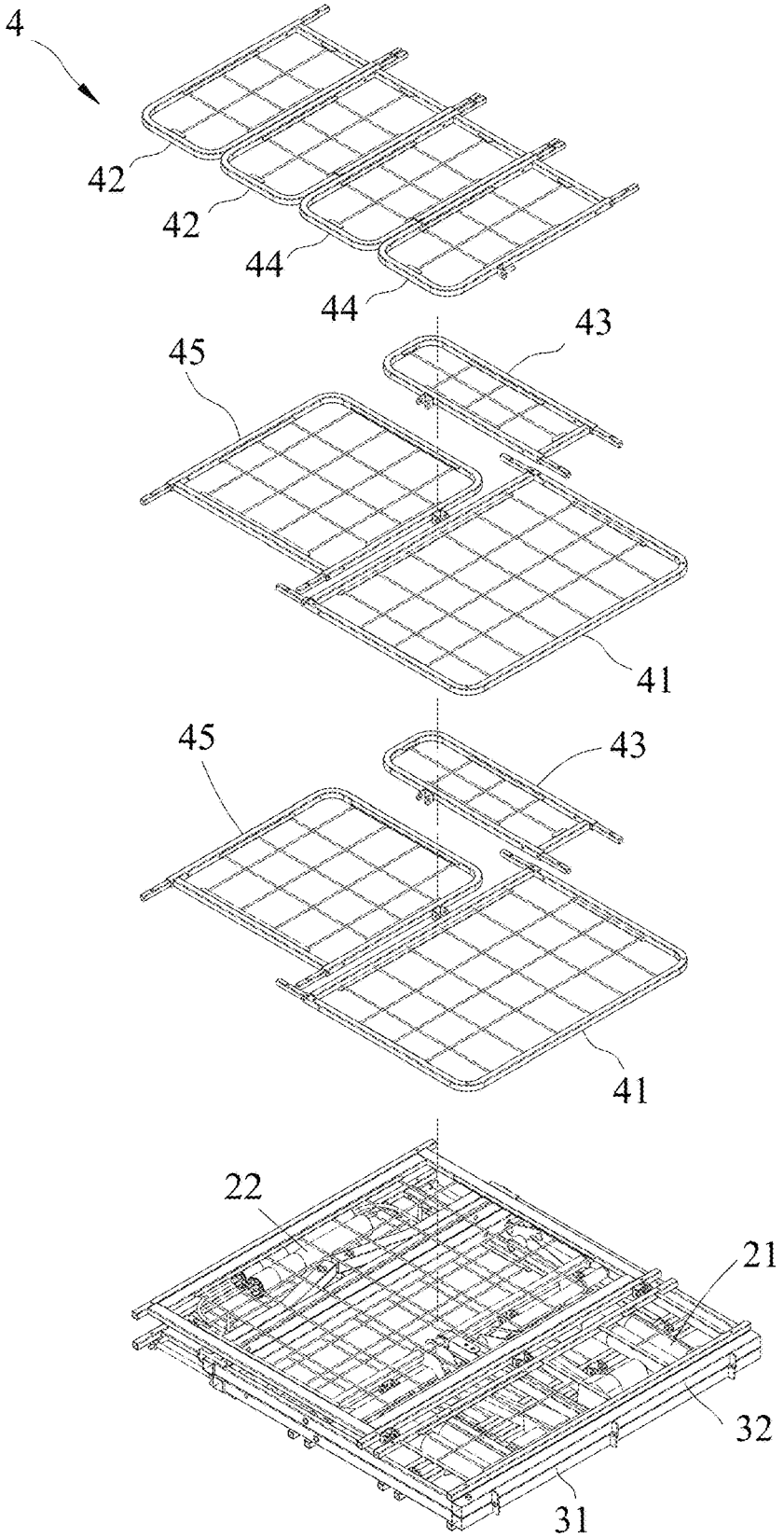
FIG. 11 is a partly exploded perspective view of the embodiment illustrating how the lateral bed frame units are placed on a stack of the first bed frame subunit and the second bed frame subunit.
Figure 12:
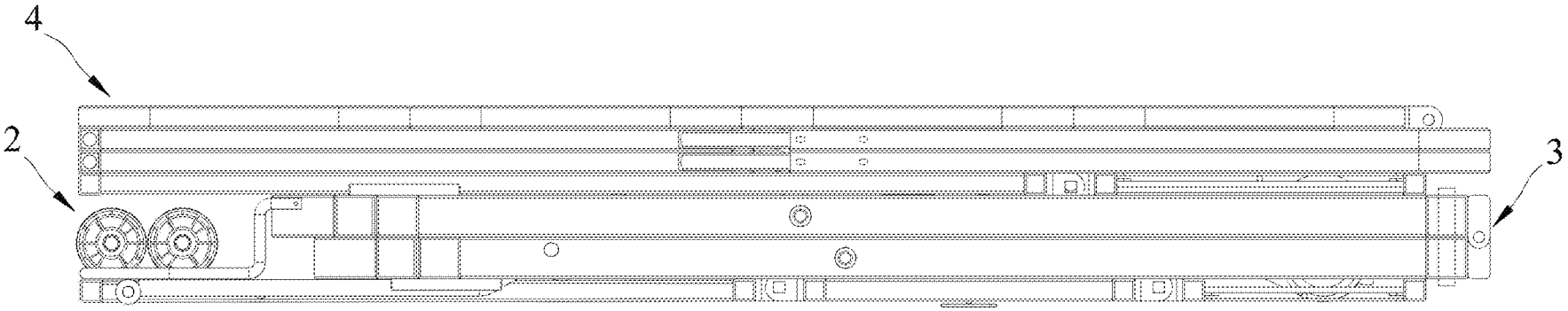
FIG. 12 is a side view of the embodiment illustrating the width-adjustable foldable bed in the folded state.

Referring to FIGS. 10, 11, and 12 in combination with FIG. 1, to transport the width-adjustable foldable bed of the disclosure, the lateral bed frame units 4, the outer bed legs 21, and the intermediate bed legs 22 are disassembled from the first bed frame subunit 31 and the second bed frame subunit 32. The first bed frame subunit 31 and the second bed frame subunit 32 are stacked on each other such that the main bed frame unit 3 is in the bed folded state, and the outer bed legs 21 and the intermediate bed legs 22 are disposed within a space defined by the first bed frame subunit 31 and the second bed frame subunit 32. The lateral backrest frames 41, the first lateral fixing frames 42, the second lateral fixing frames 43, the lateral leg frames 44, and the lateral foot frames 45 of the lateral bed frame units 4 are sequentially stacked on the second bed frame subunit 32 as shown in FIG. 11. As a result, the width-adjustable foldable bed of the disclosure is operable to be converted from a flattened state as shown in FIG. 1 to a folded state as shown in FIGS. 10 and 12. When the width-adjustable foldable bed in the folded state, a dimension of the width-adjustable foldable bed may decrease to effectively lower the transport cost for the network-based sale of the width-adjustable foldable bed.

The width-adjustable foldable bed of the disclosure has the following effects.

1. By virtue of the lateral bed frame units 4 being respectively and detachably connected to two lateral sides of the first bed frame subunit 31 and the second bed frame subunit 32 in the widthwise direction (X) when the main bed frame unit 3 is in the bed flat state, a width of the width-adjustable foldable bed of the disclosure is increased; that is, the width-adjustable foldable bed of the disclosure is in the form of a double bed. In addition, to transport the width-adjustable foldable bed, the lateral bed frame units 4 are detached from the first bed frame subunit 31 and the second bed frame subunit 32, such that a width of the width-adjustable foldable bed is decreased and a package dimension of the width-adjustable foldable bed is reduced to lower the transport cost for the network-based sale of the width-adjustable foldable bed.
2. As shown in FIGS. 1 and 5, by virtue of the connecting tube portions 454 and the connecting pins 453 of each of the lateral bed frame units 4, the lateral bed frame units 4 are conveniently assembled with or disassembled from the first bed frame subunit 31 and the second bed frame subunit 32.
3. For each of the lateral bed frame units 4, because the coupling sets 46 are disposed between the second lateral fixing frame 43 and the lateral leg frame 44 and between the lateral leg frame 44 and the lateral foot frame 45, each of the lateral bed frame units 4 may be enhanced in overall structural strength, and a force acting on a single one of the second lateral fixing frame 43, the lateral leg frame 44, and the lateral foot frame 45 may be reduced, such that the second lateral fixing frame 43, the lateral leg frame 44, and the lateral foot frame 45 are unlikely to be deformed.
4. Because each of the main backrest frame 311, the first main fixing frame 312, the second main fixing frame 321, the main leg frame 322, and the main foot frame 323 is a lattice frame, an overall weight of the width-adjustable foldable bed may be reduced to lower the transport cost for the network-based sale while the overall structural strength of the width-adjustable foldable bed may be maintained.
5. As shown in FIGS. 3 and 7, each of the backrest connecting member 514, the backrest driving plates 516, the leg-foot connecting member 524, and the leg-foot driving plates 526 has a light weight in design so that the weight of the width-adjustable foldable bed may be further reduced to lower the transport cost. Because each of the backrest reinforcement plates 517 is connected between the backrest rotary rod 513 and the respective backrest driving plates 516, and because each of the leg-foot reinforcement plates 527 is connected between the leg-foot rotary rod 523 and the respective leg-foot driving plates 526, the backrest actuating device 51 and the leg-foot actuating device 52 are enhanced in structural strength such that a product weight and the durability may be balanced.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects; such does not mean that every one of these features needs to be practiced with the presence of all the other features. In other words, in any described embodiment, when implementation of one or more features or specific details does not affect implementation of another one or more features or specific details, said one or more features may be singled out and practiced alone without said another one or more features or specific details. It should be further noted that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A width-adjustable foldable bed comprising:

a support unit;

a main bed frame unit that is disposed on said support unit, and that includes a first bed frame subunit and a second bed frame subunit connected to said first bed frame subunit, said second bed frame subunit being pivotable relative to said first bed frame subunit to fold said main bed frame unit from a bed flat state, where said first bed frame subunit and said second bed frame subunit are arranged in a lengthwise direction, to a bed folded state, where said first bed frame subunit is stacked on top of said second bed frame subunit;

two lateral bed frame units that are respectively and detachably connected to two lateral sides of said first bed frame subunit, that are respectively and detachably connected to two lateral sides of said second bed frame subunit, and that are opposite to each other in a widthwise direction perpendicular to the lengthwise direction; and a driving unit that includes a backrest actuating device connected to said first bed frame subunit, and that is operable for driving said first bed frame subunit to switch between a first flat state and a first bent state;

wherein said first bed frame subunit includes a main backrest frame and a first main fixing frame pivotally connected to said main backrest frame;

wherein said second bed frame subunit includes a second main fixing frame that is pivotally connected to said first main fixing frame, a main leg frame that is pivotally connected to said second main fixing frame, and a main foot frame that is pivotally connected to said main leg frame; and wherein each of said lateral bed frame units includes a lateral backrest frame that is detachably connected to said main backrest frame, a first lateral fixing frame that is detachably connected to said first main fixing frame, a second lateral fixing frame that is detachably connected to said second main fixing frame, a lateral leg frame that is detachably connected to said main leg frame, and a lateral foot frame that is detachably connected to said main foot frame.

2. The width-adjustable foldable bed as claimed in claim 1, wherein:

each of said lateral bed frame units further includes a plurality of coupling sets; and for each of said lateral bed frame units, said coupling sets are disposed between said second lateral fixing frame and said lateral leg frame, and between said lateral leg frame and said lateral foot frame, such that said second lateral fixing frame and said lateral leg frame are detachably and pivotally connected to each other, and that said lateral leg frame and said lateral foot frame are detachably and pivotally connected to each other.

3. The width-adjustable foldable bed as claimed in claim 2, wherein:

each of said coupling sets has a hole plate seat and a securing pin that detachably extends in the widthwise direction into said hole plate seat;

for each of said coupling sets disposed between said second lateral fixing frame and said lateral leg frame, said hole plate seat and said securing pin are respectively disposed on said second lateral fixing frame and said lateral leg frame; and for each of said coupling sets disposed between said lateral leg frame and said lateral foot frame, said hole plate seat and said securing pin are respectively disposed on said lateral foot frame and said lateral leg frame.

4. The width-adjustable foldable bed as claimed in claim 1, wherein each of said lateral backrest frame, said first lateral fixing frame, said second lateral fixing frame, said lateral leg frame, and said lateral foot frame is a lattice frame.

5. The width-adjustable foldable bed as claimed in claim 1, wherein each of said main backrest frame, said first main fixing frame, said second main fixing frame, said main leg frame, and said main foot frame is a lattice frame.

6. The width-adjustable foldable bed as claimed in claim 1, wherein:

said first bed frame subunit further includes a first bed seat that has a first connecting frame portion supporting said first main fixing frame, and two first lateral portions spaced apart from each other in the widthwise direction and elongated in the lengthwise direction, said main backrest frame being movably disposed on said first lateral portions;

said backrest actuating device includes a backrest actuating motor that is mounted on said first connecting frame portion, a backrest actuating rod that telescopically extends from said backrest actuating motor in the lengthwise direction, a backrest rotary rod that is elongated in the widthwise direction and that rotatably interconnects said first lateral portions, a backrest connecting member that has an end pivotally connected to said backrest actuating rod and an opposite end fixedly connected to said backrest rotary rod, two backrest driving plates that are spaced apart from each other in the widthwise direction, that are pivotally connected to opposite ends of said backrest rotary rod, and that extend opposite to said backrest connecting member, each of said backrest driving plates having a distal end that is distal from said backrest rotary rod, and a plurality of backrest rollers that are rotatably mounted to said backrest driving plates; and said backrest actuating motor is operable to actuate telescopic action of said backrest actuating rod to result in rotation of said backrest rotary rod via pivot connection between said backrest actuating rod and said backrest connecting member, so that said distal ends of said backrest driving plates are driven to move upwardly to pivot said main backrest frame relative to said first main fixing frame, during which said backrest rollers roll along said main backrest frame, thereby switching said first bed frame subunit to the first bent state.

7. The width-adjustable foldable bed as claimed in claim 6, wherein said backrest actuating device further includes a backrest support rod that is elongated in the lengthwise direction and that interconnects said first connecting frame portion of said first bed seat and said backrest rotary rod, said backrest rotary rod being rotatable relative to said backrest support rod.

8. The width-adjustable foldable bed as claimed in claim 6, wherein:

said backrest actuating device further includes two backrest reinforcement plates;

each of said backrest reinforcement plates is connected between said backrest rotary rod and a respective one of said backrest driving plates; and each of said backrest reinforcement plates is parallel to the lengthwise direction and the widthwise direction when said first bed frame subunit is in the first flat state.

9. The width-adjustable foldable bed as claimed in claim 6, wherein:

each of said backrest driving plates has an extension portion that extends from said backrest rotary rod, and a bent portion that extends from said extension portion and that has said distal end of said backrest driving plate, an included angle being formed between said extension portion and said bent portion and being smaller than 180 degrees; and said backrest rollers are respectively disposed on said distal ends of said backrest driving plates and junctions between said extension portions and said bent portions of said backrest driving plates.

* * * * *